US006578377B1

(12) United States Patent
Licht et al.

(10) Patent No.: US 6,578,377 B1
(45) Date of Patent: Jun. 17, 2003

(54) RECOVERY OF HYDROGEN AND CARBON MONOXIDE FROM MIXTURES INCLUDING METHANE AND HYDROCARBONS HEAVIER THAN METHANE

(75) Inventors: William Robert Licht, Allentown, PA (US); Richard Adrian Long, Little Bookham, Leatherhead (GB); David Richard Barnes, Jr., Laurys Station, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 10/095,993

(22) Filed: Mar. 11, 2002

(51) Int. Cl.[7] ..... F25J 3/00
(52) U.S. Cl. ..... 62/620; 62/932
(58) Field of Search ..... 62/617, 620, 920, 62/932

(56) References Cited

U.S. PATENT DOCUMENTS 3,339,371 A * 9/1967 Ichihara ..... 62/619
3,442,090 A * 5/1969 Baibakov et al. ..... 62/620
3,813,889 A * 6/1974 Allam et al. ..... 62/639
4,478,621 A 10/1984 Fabian ..... 62/31
4,888,035 A 12/1989 Bauer ..... 62/20
5,295,356 A 3/1994 Billy ..... 62/20
5,592,831 A 1/1997 Bauer et al. ..... 62/625
5,596,883 A * 1/1997 Bernhard et al. ..... 165/166
6,082,134 A 7/2000 McNeil et al. ..... 62/632
6,269,657 B1 8/2001 McNeil ..... 62/631

FOREIGN PATENT DOCUMENTS

GB 1579553 11/1980 ..... B01D/53/14

* cited by examiner

*Primary Examiner*—William C. Doerrler
(74) *Attorney, Agent, or Firm*—John M. Fernbacher

(57) ABSTRACT

Method for the recovery of hydrogen and carbon monoxide from a feed gas mixture containing hydrogen, carbon monoxide, methane, and hydrocarbons heavier than methane. The method comprises utilizing a cryogenic methane wash column to recover hydrogen from an intermediate feed stream containing hydrogen, carbon monoxide, methane, and hydrocarbons heavier than methane, wherein the methane wash column utilizes a methane wash stream which contains less than about 5 mole % of hydrocarbons heavier than methane, and wherein the methane wash stream consists of components obtained from the intermediate feed stream.

10 Claims, 2 Drawing Sheets

RECOVERY OF HYDROGEN AND CARBON MONOXIDE FROM MIXTURES INCLUDING METHANE AND HYDROCARBONS HEAVIER THAN METHANE

BACKGROUND OF THE INVENTION

Hydrogen and carbon monoxide, which are important reactants in many processes in the chemical and petroleum refining industries, can be recovered from various gas mixtures containing hydrogen, carbon monoxide, methane, and inert gases such as nitrogen and argon. These gas mixtures can be generated by the steam reforming of natural gas or light naphtha followed by removal of water and carbon dioxide. Cryogenic distillation and pressure swing adsorption are well-known separation methods used to recover individual high-purity hydrogen and carbon monoxide products from these gas mixtures.

Hydrogen and carbon monoxide also can be recovered from certain offgas mixtures available in petroleum refineries and petrochemical plants. For example, offgas from acetylene production can contain these components in economically recoverable concentrations, but may contain low concentrations of ethane and heavier hydrocarbons in addition to hydrogen, methane, carbon monoxide, carbon dioxide, water, and inert gases. When ethane and heavier hydrocarbons are present in these offgas mixtures at certain concentration levels, modified separation steps may be required for recovering hydrogen and carbon monoxide from these mixtures.

The present invention, which is described below and defined by the claims which follow, addresses the recovery of hydrogen and carbon monoxide from gas mixtures containing these two components in admixture with methane and hydrocarbons heavier than methane.

BRIEF SUMMARY OF THE INVENTION

The invention relates to a method for the recovery of hydrogen and carbon monoxide from a feed gas mixture containing hydrogen, carbon monoxide, methane, and hydrocarbons heavier than methane, which method comprises:

(a) separating the feed gas mixture containing hydrogen, carbon monoxide, methane, and hydrocarbons heavier than methane to yield an intermediate feed stream depleted in hydrocarbons and a reject stream enriched in hydrocarbons heavier than methane;

(b) separating the intermediate feed stream in a cryogenic separation system to yield a hydrogen-rich overhead product stream and one or more intermediate streams enriched in carbon monoxide and methane, wherein the separation system includes an absorption column refluxed with a methane-rich liquid reflux stream;

(c) introducing the one or more streams enriched in carbon monoxide and methane into a cryogenic distillation system and withdrawing therefrom a carbon monoxide-enriched overhead product stream and a liquid bottoms stream enriched in methane; and (d) utilizing at least a portion of the liquid bottoms stream enriched in methane in (c) to provide the methane-rich liquid reflux stream in (b).

Separating the feed gas mixture in (a) may comprise cooling and partially condensing the feed gas mixture to yield a two-phase feed mixture, and separating the two-phase feed mixture to yield a vapor stream which provides the intermediate feed stream depleted in hydrocarbons and a liquid stream which provides the reject stream enriched in hydrocarbons heavier than methane.

The cryogenic separation system of (b) may include a partial condensation step in which the intermediate feed stream is cooled, partially condensed, and separated into a vapor feed stream and a liquid feed stream, wherein the vapor feed stream is introduced into the absorption column which is refluxed with a methane-rich liquid reflux stream, and wherein the liquid feed stream is introduced into the cryogenic separation system downstream of the absorption column.

The ratio of the molar concentration of hydrocarbons heavier than methane in the intermediate feed stream to the molar concentration of methane in the intermediate feed stream may be maintained at less than about 0.05, and may be maintained at less than about 0.02.

The invention also broadly relates to a method for the recovery of hydrogen and carbon monoxide from a feed gas mixture containing hydrogen, carbon monoxide, methane, and hydrocarbons heavier than methane, which method comprises utilizing a cryogenic methane wash column to recover hydrogen from an intermediate feed stream containing hydrogen, carbon monoxide, methane, and hydrocarbons heavier than methane, wherein the methane wash column may utilize a methane wash stream which contains less than about 5 mole % of hydrocarbons heavier than methane, and wherein the methane wash stream consists of components obtained from the intermediate feed stream. The methane wash stream may contain less than about 2 mole % of hydrocarbons heavier than methane.

The invention also relates to a system for the recovery of hydrogen and carbon monoxide from a feed gas mixture containing hydrogen, carbon monoxide, methane, and hydrocarbons heavier than methane, which method comprises:

(a) means for separating the feed gas mixture containing hydrogen, carbon monoxide, methane, and hydrocarbons heavier than methane to yield an intermediate feed stream depleted in hydrocarbons and a reject stream enriched in hydrocarbons heavier than methane;

(b) a cryogenic separation system for separating the intermediate feed stream to yield a hydrogen-rich overhead product stream and one or more intermediate streams enriched in carbon monoxide and methane, wherein the separation system includes an absorption column refluxed with a methane-rich liquid reflux stream;

(c) a cryogenic distillation system for separating the one or more streams enriched in carbon monoxide and methane into a carbon monoxide-enriched overhead product stream and a liquid bottoms stream enriched in methane; and (d) piping means to transfer at least a portion of the liquid bottoms stream enriched in methane from the cryogenic distillation system to provide the methane-rich liquid reflux stream to the absorption column in the first cryogenic separation system.

The means for separating the feed gas mixture in (a) may comprise heat exchange means for cooling and partially condensing the feed gas mixture to yield a two-phase feed mixture, and a vapor-liquid separator for separating the two-phase feed mixture to yield a vapor stream which provides the intermediate feed stream depleted in hydrocarbons and a liquid stream which provides the reject stream enriched in hydrocarbons heavier than methane.

The cryogenic separation system of (b) may include heat exchange means for cooling and partially condensing the feed gas mixture to yield a two-phase feed mixture, a vapor-liquid separator for separating the two-phase feed mixture to yield a vapor feed stream and a liquid feed stream, piping means for introducing the vapor feed stream into the absorption column which is refluxed with a methane-rich liquid reflux stream, and piping means to introduce the liquid feed stream into the cryogenic separation system downstream of the absorption column.

DETAILED DESCRIPTION OF THE INVENTION

A conventional process for separating hydrogen and carbon monoxide comprises a low temperature scrubbing step using liquid methane to dissolve carbon monoxide and produce a hydrogen-rich overhead product, a hydrogen stripping column or flash separator to separate residual hydrogen from the CO-loaded methane (containing about 3%–4% $H_2$), and a carbon monoxide/methane separation column to separate the hydrogen-stripped CO-loaded methane into a carbon monoxide-rich overhead product and a methane bottoms fraction. The hydrogen stripping column normally operates at pressures between the pressures of the methane wash and carbon monoxide/methane separation columns.

Figure 1:
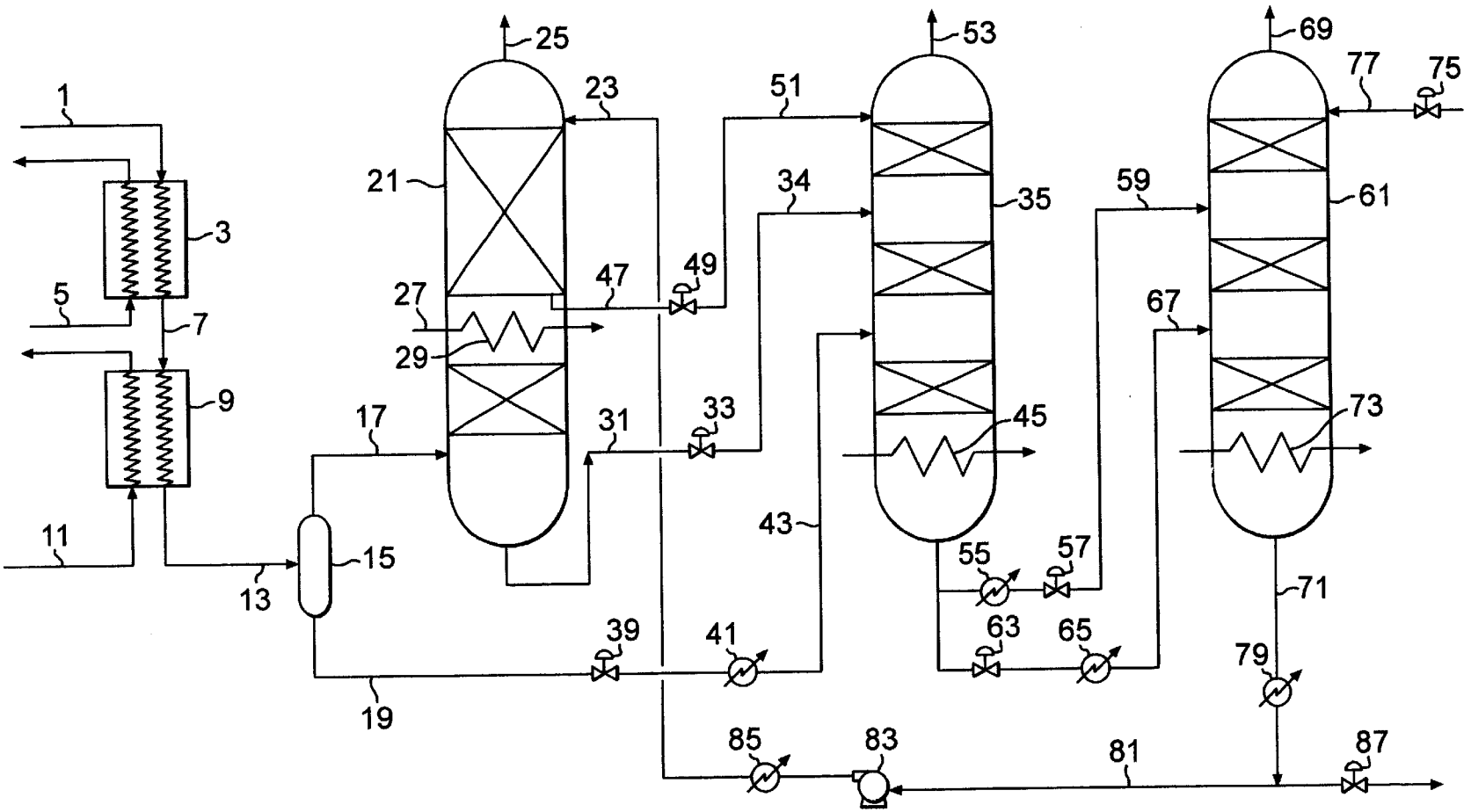
FIG. 1 (PRIOR ART)
FIG. 1 is a process flow diagram for a known cryogenic process to recover hydrogen and carbon monoxide from synthesis gas.

One embodiment of this known process is illustrated in the flow diagram of FIG. 1. In this exemplary process, a feed gas mixture containing hydrogen, carbon monoxide, methane, and hydrocarbons heavier than methane (including ethane and optionally propane) enters via line 1 and is cooled in heat exchanger 3 by indirect heat transfer with a refrigerant or cold process stream supplied in line 5. The feed gas mixture preferably has been treated previously to remove water, carbon dioxide, and other contaminants (not shown). The cooled steam in line 7 is further cooled in heat exchanger 9 by indirect heat transfer with another refrigerant or cold process stream supplied in line 11. A partially condensed intermediate feed stream flows via line 13 into separator 15, from which an intermediate vapor feed stream depleted in hydrocarbons is withdrawn in line 17 and a liquid stream enriched in hydrocarbons is withdrawn in line 19.

The intermediate vapor feed stream via line 17 is introduced into the bottom of methane wash column 21. The vapor rising up through the wash column trays or packing is scrubbed with a liquid methane reflux stream or methane wash stream introduced at the top of the column via line 23. This dissolves carbon monoxide into the liquid methane and produces an overhead hydrogen-rich product in line 25 containing only small quantities of carbon monoxide and methane. The heat of solution of carbon monoxide in the wash liquid may be removed by indirect heat exchange with at least part of a liquid carbon monoxide heat pump refrigerant stream supplied via line 27 to heat exchanger 29. Heat exchanger 29 is shown schematically and may include multiple heat exchangers. The number of heat exchangers and their position and configuration within the methane wash column stages typically are selected to provide near isothermal operation of the column.

The loaded liquid carbon monoxide/methane mixture from the bottom of methane wash column 21 typically contains about 3 to 4 mole % $H_2$ and is removed via line 31, reduced in pressure by control valve 33, and introduced via line 34 into hydrogen stripping column 35. This column contains trays or packing in which hydrogen is stripped from the liquid in order to achieve the required carbon monoxide product purity specification. Condensed liquid in line 19 from separator 15 is reduced in pressure by control valve 39 and partially vaporized in heat exchanger 41, preferably by indirect heat exchange with at least part of the crude synthesis gas from heat exchanger 3. Alternatively, other heat exchange means may be provided. The partly vaporized liquid is then fed via line 43 to hydrogen stripping column 35 several stages below the introduction of the liquid in line 34 to provide part of the stripping vapor for hydrogen removal from the latter stream.

A reboiler 45 in the bottom of hydrogen stripping column 35 provides stripping vapor for the liquid in both feed streams. The liquid introduced via line 34 also serves to scrub some of the carbon monoxide from the vapor passing through hydrogen stripping column 35. A methane-rich scrubbing liquid is withdrawn from an appropriate stage of the methane wash column via line 47, reduced in pressure by control valve 49, and used to provide wash liquid via line 51 to the top of hydrogen stripping column 35 to further reduce carbon monoxide losses in the reject overhead hydrogen stream in line 53.

Liquid from the bottom of hydrogen stripping column 35 is divided in two branch streams. The first stream is subcooled in heat exchanger 55, reduced in pressure by control valve 57, and introduced via line 59 to carbon monoxide/methane separation column 61. The second stream is reduced in pressure by control valve 63, partially vaporized in heat exchanger 65, and is introduced via line 67 to carbon monoxide/methane separation column 61 several stages below the subcooled liquid in line 59. These two feed streams are separated in carbon monoxide/methane separation column 61 into carbon monoxide-rich overhead product vapor in line 69 and methane-rich bottoms stream in line 71. The column is reboiled by reboiler 73 and reflux is provided by direct introduction of liquid carbon monoxide via control valve 75 and line 77. Heat transfer in heat exchangers 55 and 65 is accomplished by indirect heat exchange with other process streams and is not detailed here.

Methane-rich liquid in line 71 is subcooled in subcooler 79 by indirect heat exchange with other process streams (not detailed here) and then is divided into two streams. The major portion flows via line 81, is pumped by pump 83 to methane wash column pressure, is further subcooled in heat exchanger 85, and is introduced to the top of methane wash column 21 via line 23. The minor portion of stream 71 is removed from the distillation system via control valve 87.

The vapor in hydrogen stripper column 35 as described above is contacted with methane-rich liquid withdrawn via line 51 from an intermediate stage of methane wash column 21, preferably from the stage above heat exchanger 29. Alternatively, this liquid could be withdrawn from any stage of methane wash column 21 above the bottom stage, and suitably may be withdrawn from a higher stage than the preferred location if lower carbon monoxide losses are desired, since liquid from higher up the column will have a lower carbon monoxide content.

Alternatively, liquid withdrawn from the bottom stage of methane wash column 21 via line 31 may be combined with the condensed liquid in line 19 from separator 15 prior to pressure reducing control valve 39. This will simplify the system by eliminating valve 33 and line 34, which may be appropriate on a smaller scale plant where the power saved by using this feature does not justify the additional cost.

Heat exchangers 41, 55, and 65 are typically present and are generally accepted as being cost effective even for small plants. The scrubbing liquid methane must be cold enough to satisfactorily absorb the carbon monoxide in methane wash column 21, and such subcooling is advantageously achieved by at least one heat exchanger and preferably two, such as exchangers 79 and 85 communicating with the recycled methane.

In an alternative pretreatment process, the liquid from the bottom of hydrogen stripping column 35 may be subcooled in heat exchanger 55, and then divided into two branch streams. The first stream would feed carbon monoxide/methane separation column 61 and the second stream would be reduced in pressure and partially vaporized in heat exchanger 65, before feeding to carbon monoxide/methane separation column 61 at a lower location than the first stream.

The methane-rich bottoms stream in line 71 contains essentially all hydrocarbons heavier than methane which are present in the feed gas mixture in line 1. The concentration of hydrocarbons heavier than methane in this stream may range up to 10 mole % depending on the source of the feed gas mixture. These heavier hydrocarbons may include ethane, propane, and small amounts of $C_4^+$ hydrocarbons.

It has been discovered in the present invention that the presence of hydrocarbons heavier than methane in the feed gas mixture can adversely affect the operation of methane wash column 21 and to a lesser degree the operation of carbon monoxide/methane separation column 61. It is therefore desirable in these cases to remove at least a portion of the hydrocarbons heavier than methane which are present in the feed gas mixture in line 1. This may be accomplished, for example, by the process illustrated in the embodiment of FIG. 2. In this example process, feed gas in line 1 is cooled and partially condensed in heat exchanger 3, and the partially condensed stream is withdrawn via line 201 to phase separator 203 where it is separated into a vapor stream in line 205 which is depleted in hydrocarbons and a liquid reject stream in line 207 containing a major portion of the hydrocarbons heavier than methane. The condensed heavier hydrocarbons are withdrawn for use elsewhere, for example as fuel. The vapor in line 205 is further cooled and partially condensed in heat exchanger 9 as earlier described. The two-phase intermediate feed in line 13 then is processed as earlier described.

The performance of distillation columns which utilize trays as mass transfer devices may be adversely affected by high levels of foam or froth which is formed by vapor-liquid contact on the trays. If the height of the foam or froth is greater than the tray spacing, separation will be adversely affected and product purity will decrease. This phenomenon may occur at certain conditions in cryogenic absorption columns which separate hydrogen from mixtures of hydrogen, carbon monoxide, methane, and hydrocarbons heavier than methane using a methane wash or reflux stream containing some hydrocarbons heavier than methane, and this led to the present invention. This foaming problem may be reduced, for example, by increasing tray spacing, reducing vapor velocity, increasing column diameter, or redesigning the mass transfer devices. It is believed from work carried out in support of the invention that foam or froth height may be a function of composition, particularly liquid composition. In particular, it is believed that the presence of excessive amounts of hydrocarbons heavier than methane may cause increased foam or froth heights in vapor-liquid mixtures of hydrogen, carbon monoxide, and methane. The present invention thus is directed at the removal of hydrocarbons heavier than methane from feed streams containing hydrogen, carbon monoxide, methane, and hydrocarbons heavier than methane prior to cryogenic distillation to recover hydrogen and carbon monoxide products.

Figure 2:
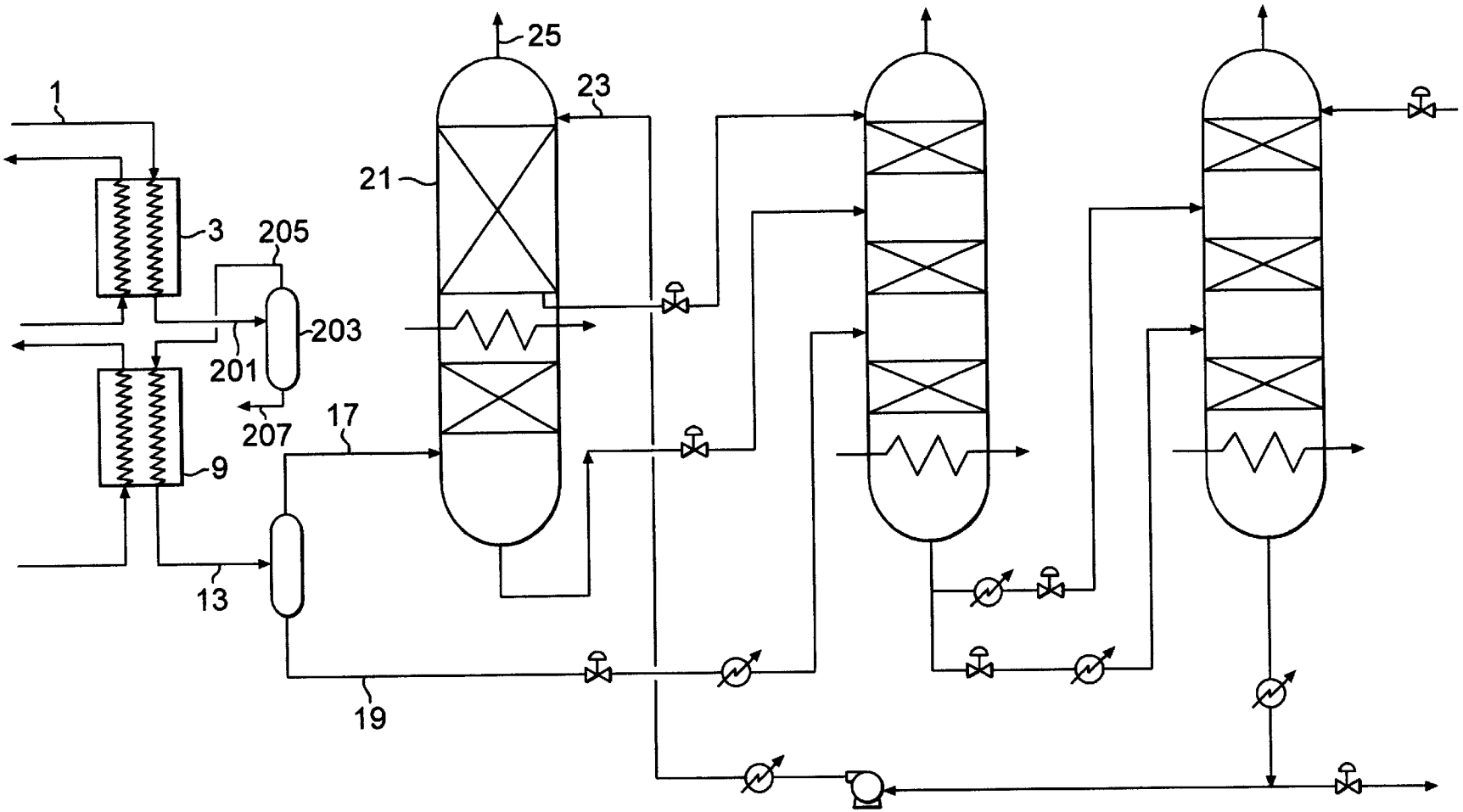
FIG. 2 is an exemplary modified cryogenic process to recover hydrogen and carbon monoxide according to the present invention.

The process of the present invention according to FIG. 2 may be operated such that the ratio of the molar concentration of hydrocarbons heavier than methane in intermediate feed stream 13 to the molar concentration of methane in intermediate feed stream 13 is maintained at less than about 0.05 and preferably less than about 0.02. This will result in a molar concentration of hydrocarbons heavier than methane in liquid methane reflux or methane wash stream 23 of less than about 5 mole % and preferably less than about 2 mole %.

EXAMPLE

The process of FIG. 1 is designed and operated to recover hydrogen product in line 25 at a purity of at least 98.6 mole % and carbon monoxide product in line 69 at a purity of at least 98.5 mole % from a feed gas mixture containing the following composition (in mole %): hydrogen, 64.5%; nitrogen, 0.313%; carbon monoxide, 31.8%; argon, 0.209%; methane, 2.9%; ethane, 0.198%; and propane, 0.005%. Methane wash column 21 is operated at a top column pressure of 29.0 bar abs and carbon monoxide/methane separation column 61 is operated at a top column pressure of 2.8 bar abs. It is found that, in order to meet the hydrogen product purity of at least 98.6 mole %, methane wash column 21 can be operated at a feed throughput of only 65% of design. A summary of the material balance and stream properties for this operation is given in Table 1.

TABLE 1

Stream Properties for Example

| Stream in Line No. → (FIG. 1) | 13 | 23 | 25 | 69 | 71 | 77 |
|---|---|---|---|---|---|---|
| Pressure, bar abs | 29.0 | 30.2 | 28.6 | 2.8 | 2.9 | 2.8 |
| Temperature, ° C. | −180 | −181 | −179 | −182 | −146 | −182 |
| Flow rate, kgm/h | 1784 | 489 | 1122 | 701 | 528 | 137 |
| Vapor fraction | 0.741 | 0 | 1 | 1 | 0 | 0.023 |
| Composition, mole % | | | | | | |
| Hydrogen | 64.543 | | 98.736 | 0.01 | | 0.01 |
| Nitrogen | 0.313 | | 0.034 | 0.806 | | 0.806 |
| Carbon monoxide | 31.812 | 0.150 | 0.150 | 98.571 | 0.150 | 98.571 |
| Argon | 0.209 | 0.108 | 0.017 | 0.612 | 0.108 | 0.612 |
| Methane | 2.920 | 90.653 | 1.064 | 0.001 | 90.653 | 0.001 |
| Ethane | 0.198 | 8.865 | | | 8.865 | |
| Propane | 0.005 | 0.224 | | | 0.224 | |

The process of FIG. 1 is modified according to FIG. 2 and operated on the same feed gas mixture and at the same column pressures as above. A portion of the hydrocarbons heavier than methane in the feed gas mixture is removed by partial condensation and is withdrawn as reject stream 207. It is found that the hydrogen product purity (line 25) of at least 98.6 mole % can be met when operating methane wash column 21 at a feed throughput of 100% of design. A summary of the material balance and stream properties for this operation is given in Table 2. It is seen that liquid methane reflux stream 23 contains only 2.01 mole % ethane as compared with 8.87 mole % in the process of FIG. 1.

TABLE 2

Stream Properties for Example

| Stream in Line No. → (FIG. 2) | 13 | 23 | 25 | 69 | 71 | 77 | 201 | 207 |
|---|---|---|---|---|---|---|---|---|
| Pressure, bar abs | 29.0 | 30.2 | 28.6 | 2.8 | 2.9 | 2.8 | 29.2 | 29.1 |
| Temperature, ° C. | −149 | −181 | −178 | −182 | −147 | −182 | −149 | −149 |
| Flowrate, kgm/h | 2738 | 737 | 1722 | 1083 | 790 | 215 | 2745 | 7 |
| Vapor fraction | 0.744 | 0 | 1 | 1 | 0 | 0.023 | 0.998 | 0 |
| Composition, mole % | | | | | | | | |
| Hydrogen | 64.701 | | 98.637 | 0.01 | | 0.01 | 64.543 | 0.716 |
| Nitrogen | 0.314 | | 0.028 | 0.826 | | 0.826 | 0.313 | 0.077 |
| Carbon monoxide | 31.854 | 0.150 | 0.138 | 98.533 | 0.150 | 98.533 | 31.812 | 14.686 |
| Argon | 0.209 | 0.061 | 0.010 | 0.631 | 0.061 | 0.631 | 0.209 | 0.254 |
| Methane | 2.883 | 97.778 | 1.187 | 0.001 | 97.778 | 0.001 | 2.920 | 17.759 |
| Ethane | 0.039 | 2.010 | | | 2.010 | | 0.198 | 64.493 |
| Propane | | 0.001 | | | 0.001 | | 0.005 | 2.016 |

What is claimed is:

1. A method for the recovery of hydrogen and carbon monoxide from a feed gas mixture containing hydrogen, carbon monoxide, methane, and hydrocarbons heavier than methane, which method comprises:

(a) separating the feed gas mixture containing hydrogen, carbon monoxide, methane, and hydrocarbons heavier than methane to yield an intermediate feed stream depleted in hydrocarbons and a reject stream enriched in hydrocarbons heavier than methane;

(b) separating the intermediate feed stream in a cryogenic separation system to yield a hydrogen-rich overhead product stream and one or more intermediate streams enriched in carbon monoxide and methane, wherein the separation system includes an absorption column refluxed with a methane-rich liquid reflux stream;

(c) introducing the one or more streams enriched in carbon monoxide and methane into a cryogenic distillation system and withdrawing therefrom a carbon monoxide-enriched overhead product stream and a liquid bottoms stream enriched in methane; and (d) utilizing at least a portion of the liquid bottoms stream enriched in methane in (c) to provide the methane-rich liquid reflux stream in (b).

2. The method of claim 1 wherein separating the feed gas mixture in (a) comprises cooling and partially condensing the feed gas mixture to yield a two-phase feed mixture, and separating the two-phase feed mixture to yield a vapor stream which provides the intermediate feed stream depleted in hydrocarbons and a liquid stream which provides the reject stream enriched in hydrocarbons heavier than methane.

3. The method of claim 1 wherein the cryogenic separation system of (b) includes a partial condensation step in which the intermediate feed stream is cooled, partially condensed, and separated into a vapor feed stream and a liquid feed stream, wherein the vapor feed stream is introduced into the absorption column which is refluxed with a methane-rich liquid reflux stream, and wherein the liquid feed stream is introduced into the cryogenic separation system downstream of the absorption column.

4. The method of claim 1 wherein the ratio of the molar concentration of hydrocarbons heavier than methane in the intermediate feed stream to the molar concentration of methane in the intermediate feed stream is maintained at less than about 0.05.

5. The method of claim 4 wherein the ratio of the molar concentration of hydrocarbons heavier than methane in the intermediate feed stream to the molar concentration of methane in the intermediate feed stream is maintained at less than about 0.02.

6. A method for the recovery of hydrogen and carbon monoxide from a feed gas mixture containing hydrogen, carbon monoxide, methane, and hydrocarbons heavier than methane, which method comprises utilizing a cryogenic methane wash column to recover hydrogen from an intermediate feed stream containing hydrogen, carbon monoxide, methane, and hydrocarbons heavier than methane, wherein the methane wash column utilizes a methane wash stream which contains less than about 5 mole % of hydrocarbons heavier than methane, and wherein the methane wash stream consists of components obtained from the intermediate feed stream.

7. The method of claim 6 wherein the methane wash stream contains less than about 2 mole % of hydrocarbons heavier than methane.

8. A system for the recovery of hydrogen and carbon monoxide from a feed gas mixture containing hydrogen, carbon monoxide, methane, and hydrocarbons heavier than methane, which method comprises:

(a) means for separating the feed gas mixture containing hydrogen, carbon monoxide, methane, and hydrocarbons heavier than methane to yield an intermediate feed stream depleted in hydrocarbons and a reject stream enriched in hydrocarbons heavier than methane;

(b) a cryogenic separation system for separating the intermediate feed stream to yield a hydrogen-rich overhead product stream and one or more intermediate streams enriched in carbon monoxide and methane, wherein the separation system includes an absorption column refluxed with a methane-rich liquid reflux stream;

(c) a cryogenic distillation system for separating the one or more streams enriched in carbon monoxide and methane into a carbon monoxide-enriched overhead product stream and a liquid bottoms stream enriched in methane; and (d) piping means to transfer at least a portion of the liquid bottoms stream enriched in methane from the cryogenic distillation system to provide the methane-rich liquid reflux stream to the absorption column in the first cryogenic separation system.

9. The system of claim 8 wherein the means for separating the feed gas mixture in (a) comprises heat exchange means for cooling and partially condensing the feed gas mixture to yield a two-phase feed mixture, and a vapor-liquid separator for separating the two-phase feed mixture to yield a vapor stream which provides the intermediate feed stream depleted in hydrocarbons and a liquid stream which provides the reject stream enriched in hydrocarbons heavier than methane.

10. The system of claim 8 wherein the cryogenic separation system of (b) includes heat exchange means for cooling and partially condensing the feed gas mixture to yield a two-phase feed mixture, a vapor-liquid separator for separating the two-phase feed mixture to yield a vapor feed stream and a liquid feed stream, piping means for introducing the vapor feed stream into the absorption column which is refluxed with a methane-rich liquid reflux stream, and piping means to introduce the liquid feed stream into the cryogenic separation system downstream of the absorption column.

* * * * *